US005280922A

United States Patent [19]

Jones

[11] Patent Number: 5,280,922

[45] Date of Patent: Jan. 25, 1994

[54] APPARATUS FOR TRAINING AN INDIVIDUAL TO KICK BALLS

[76] Inventor: Thomas L. Jones, 3 Indian Pl., Asheville, N.C. 28805

[21] Appl. No.: 5,838

[22] Filed: Jan. 19, 1993

[51] Int. Cl.[5] ..... A63B 69/00

[52] U.S. Cl. ..... 273/411; 273/55 B; 273/58 C; 273/413

[58] Field of Search ..... 273/55 R, 55 B, 58 C, 273/65 R, 411, 413, 414

[56] References Cited

U.S. PATENT DOCUMENTS

| | | | |
|---|---|---|---|
| 3,227,450 | 1/1966 | Pruitt | 273/55 B |
| 3,439,916 | 4/1969 | Kopp | 273/55 B |
| 3,525,523 | 8/1970 | Bellagamba et al. | 273/55 B |
| 4,158,458 | 6/1979 | Gomez | 273/413 |
| 4,634,122 | 1/1987 | Kline | 273/55 B |
| 4,720,095 | 1/1988 | Sowards | 273/413 X |
| 4,865,330 | 9/1989 | D'Amico | 273/55 B X |
| 4,991,840 | 2/1991 | Patton | 273/55 B |

FOREIGN PATENT DOCUMENTS

| | | | |
|---|---|---|---|
| 813002 | 5/1959 | United Kingdom | 273/58 C |

*Primary Examiner*—William H. Grieb
*Attorney, Agent, or Firm*—Carter and Schnedler

[57] ABSTRACT

There is provided a self-stabilized apparatus for training an individual to kick balls. The apparatus includes a platform, having a pair of vertical posts exceeding therefrom. A ball, which is preferably a soccer ball, is attached to the posts by means of elastic bands. The user places one foot on the platform while kicking the ball with the other foot so that the apparatus is self-stabilized. The elastic bands cause the ball to return to its initial position after it has been kicked.

15 Claims, 1 Drawing Sheet

APPARATUS FOR TRAINING AN INDIVIDUAL TO KICK BALLS

BACKGROUND OF THE INVENTION

This invention relates to sports training apparatus. More particularly, it relates to apparatus for training an individual to kick balls, particularly, soccer balls.

The game of soccer requires a player to be equally dexterous with either foot to be proficient at the game. Traditionally, a player is advised to kick a soccer ball against a wall to gain dexterity, particularly, using the less dominate foot. The soccer player quickly grows tired of this activity and discontinues practice because a disproportionate amount of time is spent running after a missed kick or running after the ball which ricochets off the wall and away from the player. Various devices have been devised to overcome these problems.

U.S. Pat. No. 4,720,095, issued to Sowards, shows a soccer training practice device including a ball which is attached to a anchor in the form of a helical coil. The coil includes a sharp tip which the user must first press into the ground so that the coil is anchored. Thus the ball will not travel a great distance after it is kicked. Obviously, Sowards suffers from a disadvantage in that it can be only used outdoors. In addition, the ground must be soft enough to permit one to press the helical coil into the ground. The set-up time for the Sowards apparatus is substantial.

U.S. Pat. No. 4,991,840, issued to Patton, et al., shows a tethered football practice kicking aid. The Patton patent shows the use of two stakes which are hammered into the ground to anchor the apparatus. The Patton apparatus obviously suffers from some of the similar drawbacks of the Sowards Patent.

U.S. Pat. No. 3,439,916, issued to Kopp, shows a football kick training apparatus which includes a means for holding a football either at the punting level or at the place kicking level. However, Kopp does not tether the ball to the apparatus, and thus, once the ball is kicked, the kicker must retrieve the ball.

OBJECTS OF THE INVENTION

It is therefore one object of this invention to provide an improved ball kicking training apparatus.

It is another object to provide a ball kicking training apparatus which is self-stabilizing which is not required to be anchored in the ground.

It is another object to provide an apparatus for training an individual to kick soccer balls.

It is another object to provide an apparatus for training an individual to kick balls which is easy to use and does not require substantial set-up time.

SUMMARY OF THE INVENTION

In accordance with one form of this invention there is provided a self-stabilized apparatus for training an individual to kick balls. The apparatus includes a platform and a ball. The ball is connected to the platform so that the individual may kick the ball with one foot while the other foot is in contact with the platform. Thus the weight of the individual on the platform stabilizes the apparatus while the individual is kicking the ball.

Preferably, the ball is connected to the platform by an elastic device, such as a pair of elongated elastic bands, so that the ball will return to its initial position shortly after it is kicked.

Also, preferably, the ball is a soccer ball which, in its initial position, rests on the platform prior to being kicked.

In another form of this invention, there is provided an apparatus for training an individual to kick soccer balls. The apparatus includes a soccer ball and a stabilizing device. The soccer ball is connected to the stabilizing device by an elastic device so that the ball will stay in the vicinity of the stabilizing device after the ball is kicked by the individual.

It is preferred that the platform is a thin and flat platform having a surface area of more than 100 square inches.

BRIEF DESCRIPTION OF THE DRAWINGS

The subject matter which is regarded as the invention is set forth in the appended claims. The invention itself, however, together with further objects and advantages thereof, may be better understood by references to the following description taken in conjunction with the accompanying drawings in which:

DESCRIPTION OF THE PREFERRED EMBODIMENTS

Figure 1:
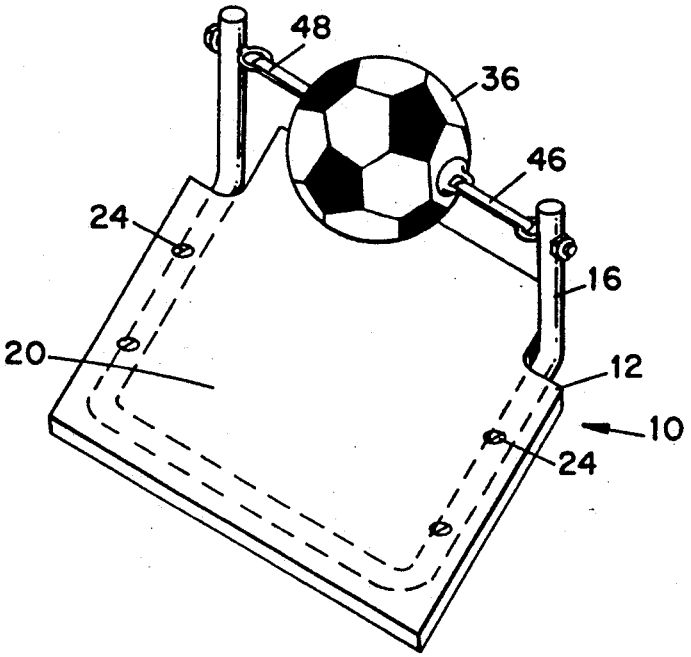
FIG. 1 is a perspective view showing the apparatus of the subject invention.

Referring now more particularly to FIGS. 1 through 4, there is provided a soccer training apparatus 10, which includes a thin, substantial flat platform 12. The bottom side 14 of the platform contacts a tubular frame 49 which contacts the ground or the floor.

A pair of identical, vertical posts 16 and 18 are fabricated on the front of the tubular frame 49 by curving the frame upward until the vertical posts 16 and 18 are at a 90 degree angle related to the remainder of the frame. The top portion of each vertical post includes a bore hole 28 for receiving bolt 30. Bolt 30 includes an eyelet 32. Bolt 30 is secured to a vertical post by means of nut 34.

The apparatus further includes ball 36, which in the preferred embodiment, is a soccer ball. A portion of 38 of the outer surface of the soccer ball makes contact with the top surface 20 of platform 12 so that the soccer ball is in the normal on ground position to be kicked. A pair of attachment devices 38 and 40, each including an eyelet 42, contact the outer surface of the ball 36. The attachment devices 38 and 40 would preferably be molded onto the ball or otherwise attached to the outer surface of the ball.

Elastic bands 46 and 48 connect the ball 36 to respective posts 16 and 18 in an identical fashion. Specifically, band 46, which in the preferred embodiment is a continuous loop rubber band, is received in eyelet 42, which is attached to ball 36, and eyelet 32 which forms a part of bolt 30. Band 48 is connected in a similar fashion to the other post and to the attachment device 40. Preferably the elastic bands are under tension. By using an elastic means, such as a continuous loop rubber band under tension, the ball will quickly return to its initial position after it is kicked.

Figure 2:
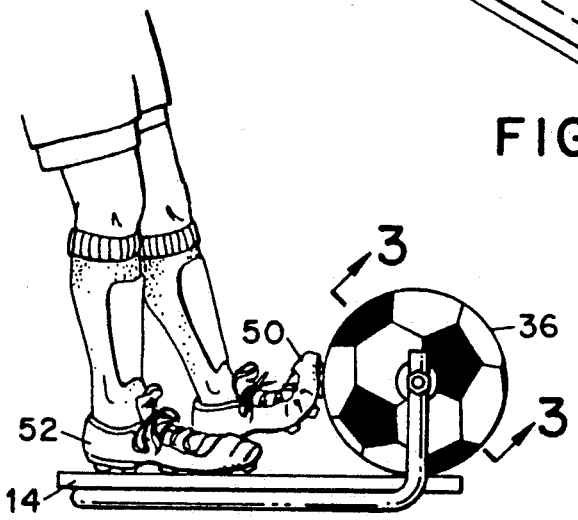
FIG. 2 is a side elevational view of the apparatus of FIG. 1 showing the feet of an individual who is using the apparatus.
Figure 3:
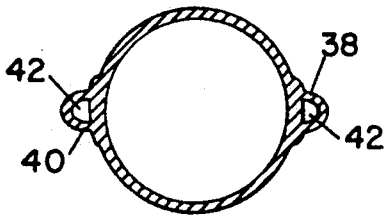
FIG. 3 is a sectional view of the ball shown in FIG. 2 taken through section line 3—3.
Figure 4:
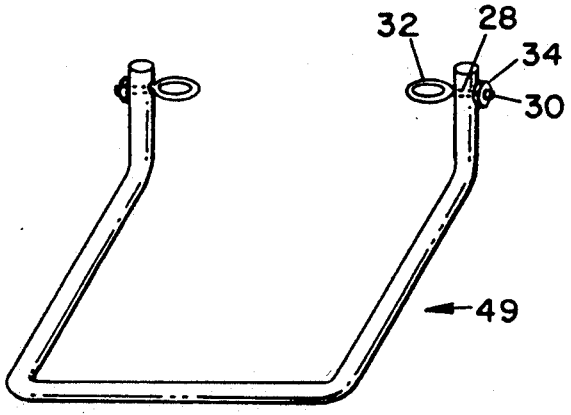
FIG. 4 is a more detailed showing of the tubular frame in FIG. 1, to which the platform and the ball are attached.

The kicking trainer 10 is utilized as follows: The kicking trainer 10 is first placed on a substantially flat surface, such as the ground or a gymnasium floor, with surface 14 of platform 12 resting on tubular frame 49, which is adjacent to the ground or floor. The user then steps onto the top surface 20 of platform 12 and proceeds to kick ball 36 with one of his or her feet 50. While the kick is taking place the user's other foot 52 remains on the top surface 20 of platform 12 bearing the full weight of the user. After foot 50 strikes the ball, the ball projects away from the platform 12, but due to the elastic nature of bands 46 and 48, it quickly returns to its initial position, as shown in FIGS. 1 and 2.

While this kicking action generates substantial forces on the ball and, through the elastic rubber bands, to posts 16 and 18, and thus to platform 12, the platform will not readily move from its resting position due to the fact that all of the weight of the individual is on the platform 12 because the individual's foot 52 remains on the top surface 20 of platform 12 during the kick, and said platform is attached by screws 24 to said tubular frame 49 which rests on the ground or floor.

After practicing kicking with foot 50 the procedure may be reversed and foot 52 may be used to kick the ball while foot 50 remains on the top surface 20 of platform 12 for stabilizing the platform. Preferably the surface area of the portion of the flat top surface of the platform which is contacted by the foot is more than 100 square inches to ensure stability.

Thus, a self-stabilizing apparatus for training an individual to kick balls is provided, which is very easy to set up and which may be used either indoors or outdoors, without the need to chase the ball after the kick has been made.

From the foregoing description of the preferred embodiment of the invention, it is apparent that many modifications may be made therein. It should be understood that it is intended in the appended claims to cover all such modifications which are in the true spirit and scope of the invention without departing from the true spirit and scope of the invention.

I claim:

1. A self-stabilized apparatus for training an individual to kick balls comprising:

a thin substantially flat platform; said platform having a foot receiving top surface;

a ball; said ball connected to said platform whereby the individual may kick said ball with one foot while the other foot is in contact with said top surface of said platform thereby stabilizing said platform.

2. An apparatus as set forth in claim 1, further including an elastic device; said elastic device connecting said ball to said platform.

3. An apparatus as set forth in claim 2, further including a pair of elastic devices.

4. An apparatus as set forth in claim 3, further including a pair of posts; each of said posts connected to said platform and extending upperly therefrom; said elastic devices connected to said posts.

5. An apparatus as set forth in claim 4, wherein said posts are located near one end of said platform.

6. An apparatus as set forth in claim 4, further including an eyelet attached to each post; a pair of eyelets attached to said ball; said elastic devices being a pair of continuous loop elastic bands; one of said elastic bands passing through one eyelet on said ball and one eyelet on one of said posts, and the other elastic band passing through the other eyelet on said ball and the eyelet attached to the other of said posts.

7. An apparatus as set forth in claim 1, wherein the surface area of the portion of said platform contacted by the other foot is larger than 100 square inches.

8. An apparatus as set forth in claim 1, wherein said ball is a soccer ball.

9. An apparatus as set forth in claim 1, wherein a portion of said ball contacts said platform.

10. An apparatus for training an individual to kick soccer balls comprising:

a soccer ball;

a stabilizing device, said stabilizing device being a thin substantially flat platform; said platform having a foot receiving top surface wherein the individual may kick said soccer ball with one foot while the other foot is in contact with said top surface of said platform;

an elastic device; said soccer ball connected to said stabilizing device by said elastic device, whereby said soccer ball will stay in the vicinity of said stabilizing device after said soccer ball is kicked by the individual.

11. An apparatus as set forth in claim 10, further including a post extending upperly above said platform and being attached to said platform; said elastic device attached to said post.

12. An apparatus as set forth in claim 11, further including a pair of posts extending upperly above said platform and attached to said platform.

13. An apparatus as set forth in claim 12, further including a pair of elastic devices.

14. An apparatus as set forth in claim 13, wherein the top surface of said platform is substantially flat and being larger than 100 square inches.

15. An apparatus as set forth in claim 14, wherein said posts are located near one end of said platform.

* * * * *